United States Patent [19]

Peterson

[11] Patent Number: 4,764,081

[45] Date of Patent: Aug. 16, 1988

[54] BOAT LIFT

[76] Inventor: Leonard J. Peterson, P.O. Box 301, Schofield, Wis. 54476

[21] Appl. No.: 526,347

[22] Filed: Aug. 24, 1983

[51] Int. Cl.[4] ..... B63C 3/00

[52] U.S. Cl. ..... 414/678; 114/44; 405/3; 414/756

[58] Field of Search ..... 405/3; 114/44, 365, 114/368; 414/678, 462, 756

[56] References Cited

U.S. PATENT DOCUMENTS

| | | | |
|---|---|---|---|
| 555,018 | 2/1896 | Pike | 9/34 |
| 2,294,864 | 9/1942 | Palmer | 414/678 |
| 2,632,900 | 3/1953 | Voigt | 114/365 |
| 2,829,781 | 4/1958 | Nomsen | 414/678 |
| 3,216,388 | 11/1965 | Smith | 114/43.5 |
| 3,284,052 | 11/1966 | Godbersen | 405/3 |
| 3,690,282 | 9/1972 | Busby | 114/43.5 |

*Primary Examiner*—Sherman D. Basinger
*Attorney, Agent, or Firm*—Quarles & Brady

[57] ABSTRACT

A boat lift includes a pair of straps or ropes which are secured at one end at intermediate elevations along a pair of horizontally spaced upright standards. The straps extend downwardly beneath a boat and then upwardly where they are secured about pulleys mounted on a horizontal shaft journaled at the top of the standards. Rotation of the shaft by a handwheel will shorten the straps and lift and completely overturn the boat.

7 Claims, 2 Drawing Sheets

BOAT LIFT

BACKGROUND OF THE INVENTION

This invention relates to boat lifts, and more particularly to a lift which will completely invert a boat as it is lifted so that the boat can be stored upside-down.

It is common to provide lifts at dock sides for relatively small boats and canoes which permit the boat or canoe to be lifted out of the water for storage. Such lifts are also used for lifting small boats onto larger boats.

Existing lifts are of two general types. One type employs a series of ropes or straps and pulleys which will simply lift the boat vertically out of the water and hold it at a level above the water. An example of such a lift is found in U.S. Pat. No. 555,018 issued Feb. 18, 1896 to Pike.

A second basic approach is exemplified by U.S. Pat. No. 3,216,388 issued Nov. 9, 1965 to Smith. In the Smith patent a side rail or gunwale of the small boat is hingedly connected to the transom of the larger boat and a rope or line is attached to the opposite side rail or gunwale so that the small boat can be pulled out of the water toward the transom and stored in a generally side-wise position. A variation of this approach is found in U.S. Pat. No. 3,690,282 issued Sept. 12, 1972 to Busby in which the rope extends beneath the boat from the point of hinge attachment and then over the opposite side rail so as to cradle the boat.

SUMMARY OF THE INVENTION

In accordance with the invention I provide a boat lift which includes a pair of straps each secured at one end at horizontally spaced positions at a level above the top of a boat and extending downwardly from the point of securement so as to allow the straps to cradle the boat. The straps pass completely beneath the boat and extend upwardly therefrom to an elevated position above their point of securement so that when the length of the straps is shortened the boat will be lifted and completely overturned.

In the preferred embodiment of the invention, the straps are secured at one end to a point intermediate of the height of horizontally spaced upright standards which may be mounted on the dock side or other place of storage for the boats. At the elevated position of the straps, the straps are wound about a pair of pulleys spaced along a horizontal rotatable shaft journaled on the standards. The shaft may be rotated by a handwheel to change the length of the straps and therefore lift or lower the boat, and means are provided to releasably hold the shaft against rotation.

It is the principal object of the invention to provide a simple, yet highly effective boat lift which will lift a boat from its normal upright position and store it in an upside-down position where rain or dirt cannot collect in the boat.

It is another object of the invention to provide a boat lift which does not require attachment to the boat.

The foregoing and other objects and advantages of the invention will appear in the description which follows. In the following description, reference is made to the accompanying drawings which illustrate a preferred embodiment of the invention.

DETAILED DESCRIPTION OF THE PREFERRED EMBODIMENT

Figure 1:
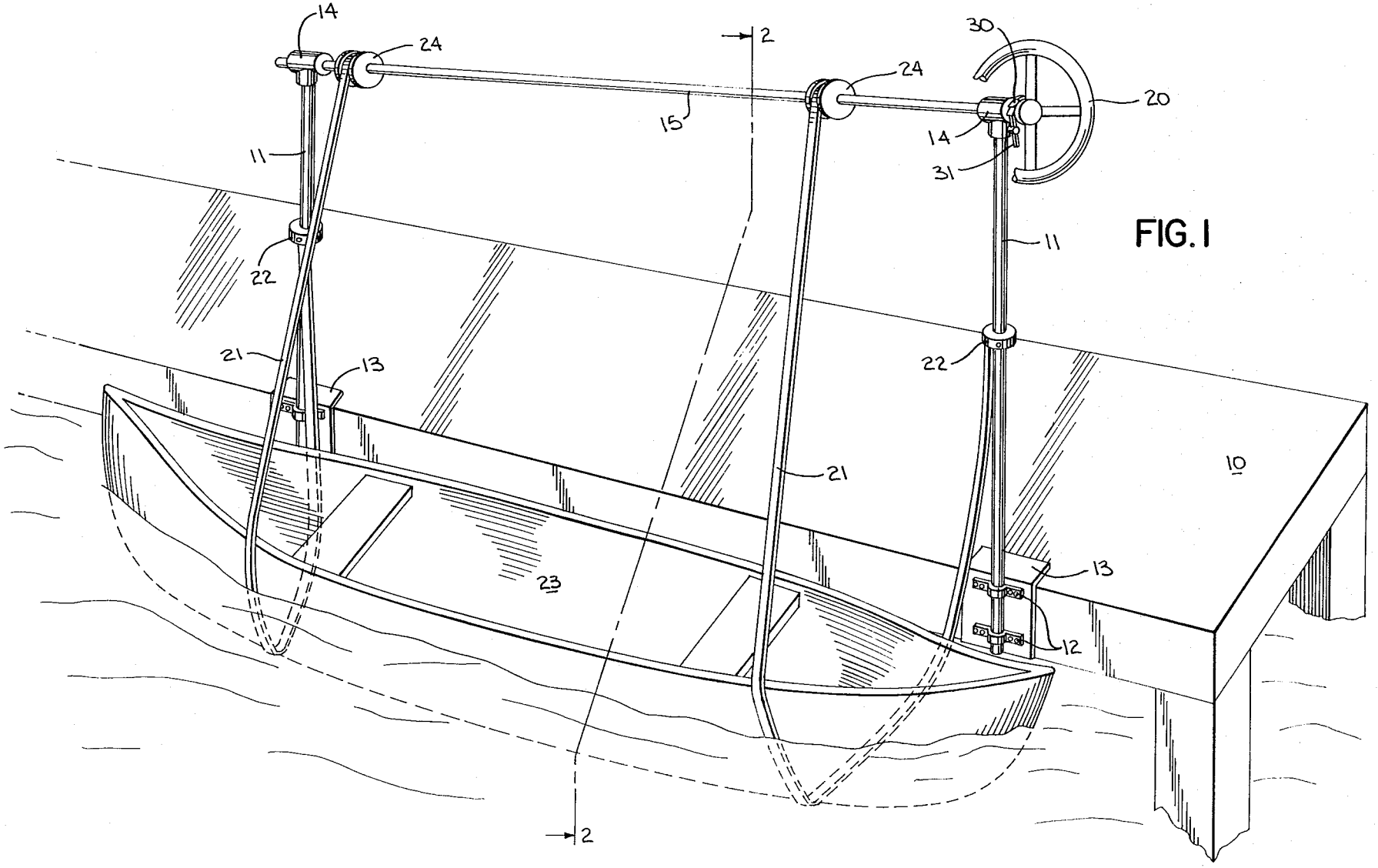
FIG. 1 is a view in perspective of the boat lift mounted at a dock side and with a canoe in place on the lift.

Referring now to the drawings, the boat lift is intended to be mounted on a support such as the side of a dock 10. A pair of upright standards 11 are spaced horizontally along the edge of the dock 10 and are mounted at their lower ends in brackets 12 secured to angle plates 13 attached to the dock side. The upper end of each standard 11 mounts a journal block 14 and a horizontal shaft 15 is disposed for rotation in the journals 14. A handwheel 20 is secured to one end of the shaft 15 projecting beyond the adjacent journal block 14.

A pair of straps or ropes 21 are each secured to an adjustable collar 22 mounted on a respective standard 11 and held in place by set screws. The straps 21 extend downwardly from the collars 22 to beneath the level of the water next to the dock 10 so that they can extend beneath a boat or canoe 23. The straps 21 extend entirely beneath the canoe 23 and then extend upwardly to the shaft 15 where the opposite end of each strap 21 is secured about a respective one of a pair of horizontally spaced pulleys 24 which are mounted to the shaft 15.

Figure 2:
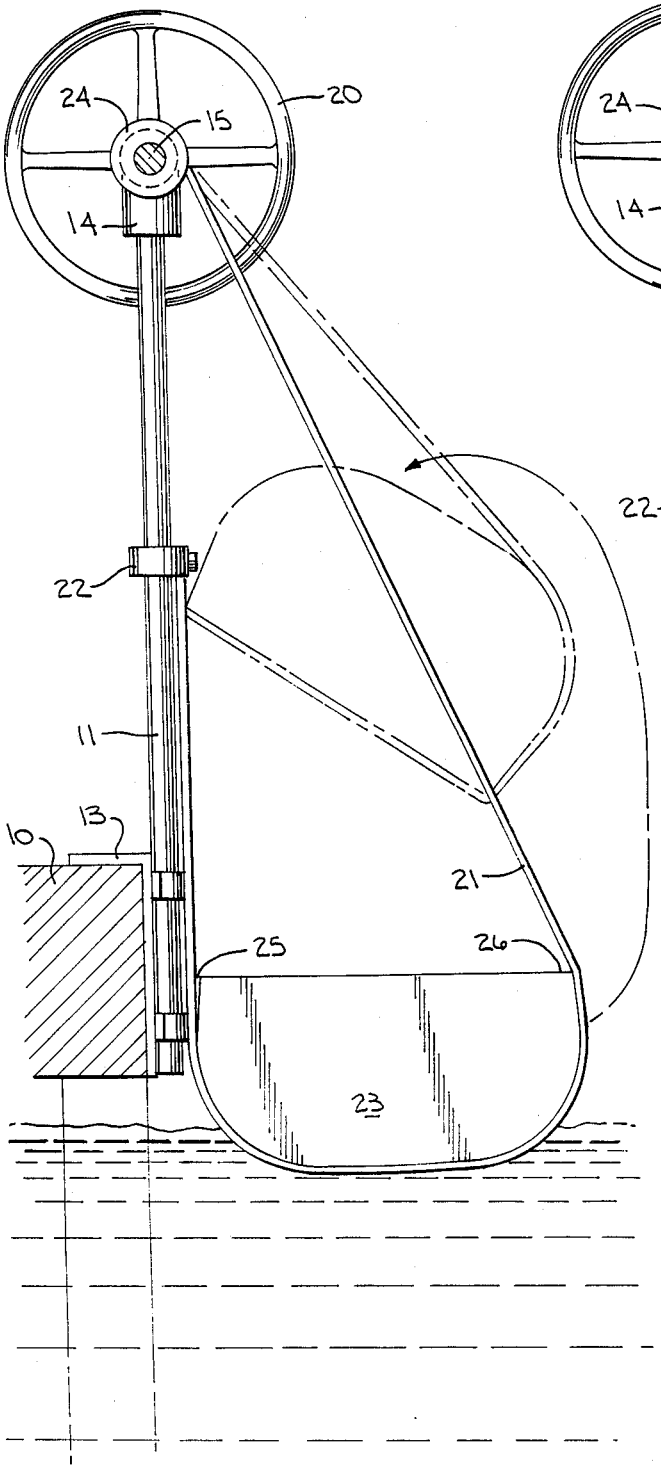
FIG. 2 is an end view in elevation of the boat lift showing the lift in a position in which it cradles the canoe in the water and showing a mid-way position of the canoe in phantom lines.
Figure 3:
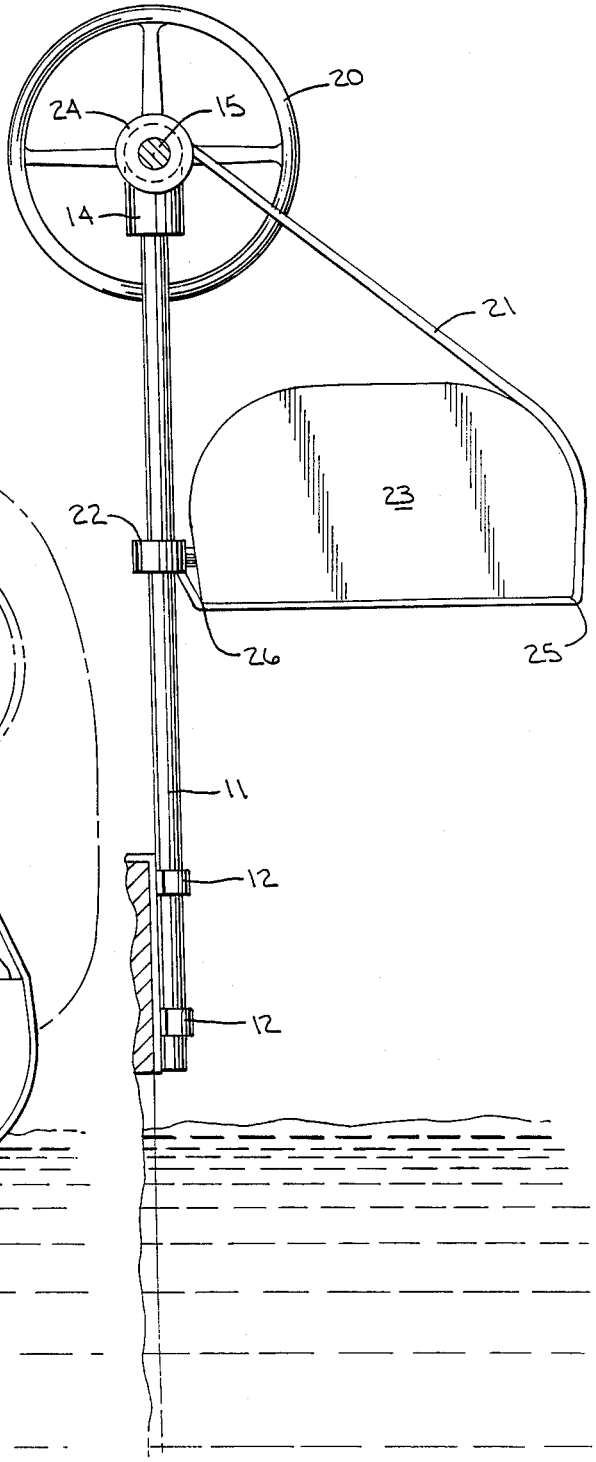
FIG. 3 is an end view similar to FIG. 2 showing the canoe in a fully elevated and stored position on the boat lift.

As will be seen in FIGS. 2 and 3, rotation of the shaft in a counterclockwise direction as viewed in FIGS. 2 and 3 will cause the straps 21 to be taken up on the pulleys 24 so that their length is shortened. This will have the effect of lifting the canoe 23 out of the water and rotating the canoe as it is lifted. The first motion will cause the gunwale or side rail 25 of the canoe 23 which is closest to the dock, and therefore closest to the vertical run of the strap, to function as a pivot point against the standards 11 so that the entire canoe 23 will rotate about that side rail 25 as the straps are shortened. As the straps continue to be shortened, the opposite side rail or gunwale 26 will engage the same vertical run of the straps 21 at which point the canoe 23 will be positioned on its side. The opposite side rail 26 of the canoe 23 then becomes the pivot point along the standards 11 and further shortening of the rope will eventually result in the cance 23 being positioned upside-down as illustrated in FIG. 3, a position in which the canoe or other boat would typically be stored.

A ratchet mechanism is provided to hold the shaft 15 against rotation so that when the boat is in its overturned storage position of FIG. 3 the shaft will not rotate to allow the boat to be accidentally lowered into the water. The ratchet mechanism includes a ratchet wheel 30 secured to the hub of the handwheel 20 and a finger 31 pivotally mounted on a boss extending from the journal block 14 adjacent the handwheel 20.

The ropes or straps 21 may be formed of a wide variety of materials including woven natural or synthetic fibers and natural or synthetic braided hollow or solid ropes. The relative coefficient of friction of the ropes or straps 21 and the boat or canoe is not important because the geometry of the lifting forces will result in overturning of the boat as it is lifted even if the ropes or straps would tend to slip over the surface of the boat or canoe.

Although the boat lift is illustrated as being attached to a dock side, it is usable on any support whether wholly on land or at the side or transom of a larger boat.

In addition to providing lifting and overturning of a boat in one operation, the lift has the very desirable feature of not requiring any attachment, permanent or temporary, to the boat. Thus, it is very simple to use and can accommodate a wide variety of small water craft.

What is claimed is:

1. A boat lift comprising:

a pair of horizontally spaced upright standards;

a horizontal shaft mounted for rotation on the standards; and a pair of straps each attached at one end to a respective standard at a point intermediate the height of the standard and below the shaft, and each strap having its other end secured about the shaft so that rotation of the shaft will change the length of the straps, said pair of straps adapted to pass beneath and cradle a boat and said straps being of a length sufficient when unwound from about said shaft that the distance from the point of attachment at said standards to the top of the boat is greater than the width of the boat so that the boat may be totally overturned when said straps are wound about said shaft.

2. A boat lift in accordance with claim 1, wherein said other ends of said straps are secured about pulleys mounted on said shaft.

3. A boat lift in accordance with claim 2, wherein a handwheel is secured to said shaft.

4. A boat lift adapted to be mounted on a dock side, comprising:

a pair of horizontally spaced upright standards adapted to be mounted on said dock side;

a horizontal shaft journaled for rotation on said standards; and a pair of straps each secured at one end to a respective standard at a point intermediate the height of the standard and below the shaft, and each strap secured at the other end about said shaft, said straps being of a length sufficient when unwound from about said shaft to pass beneath and cradle a boat floating at the dock side, and said straps being secured to said standards at an elevation above the top of the floating boat which is greater than the width of the boat so that the boat may be totally overturned when the shaft is rotated to wind the straps about the shaft.

5. A boat lift in accordance with claim 4, together with releasable means for holding the shaft against rotation.

6. A boat lift in accordance with claim 5, wherein said other ends of said straps are secured about pulleys mounted on said shaft.

7. A boat lift in accordance with claim 6, wherein a handwheel is secured to said shaft.

* * * * *